US009788660B2

(12) United States Patent
Ermalovich

(10) Patent No.: US 9,788,660 B2
(45) Date of Patent: Oct. 17, 2017

(54) MASSAGE MOTOR SUPPORT APPARATUS FOR AN ADJUSTABLE BED

(71) Applicant: ERGOMOTION, INC., Santa Barbara, CA (US)

(72) Inventor: Joseph Ermalovich, Santa Barbara, CA (US)

(73) Assignee: Ergomotion, Inc., Santa Barbara, CA (US)

( * ) Notice: Subject to any disclaimer, the term of this patent is extended or adjusted under 35 U.S.C. 154(b) by 25 days.

(21) Appl. No.: 14/921,803

(22) Filed: Oct. 23, 2015

(65) Prior Publication Data

US 2016/0113410 A1 Apr. 28, 2016

Related U.S. Application Data

(60) Provisional application No. 62/068,149, filed on Oct. 24, 2014.

(51) Int. Cl.

| | |
|---|---|
| ***A47C 21/00*** | (2006.01) |
| ***A61H 23/00*** | (2006.01) |
| ***A61G 7/05*** | (2006.01) |
| ***A61G 7/015*** | (2006.01) |
| ***A47C 20/04*** | (2006.01) |
| ***A61H 23/02*** | (2006.01) |
| ***A61G 13/00*** | (2006.01) |

(52) U.S. Cl.

CPC ..... *A47C 21/006* (2013.01); *A47C 20/041* (2013.01); *A61G 7/015* (2013.01); *A61G 13/009* (2013.01); *A61H 23/02* (2013.01); *A61H 2201/0142* (2013.01)

(58) Field of Classification Search

CPC ..... A61G 7/05; A61G 13/10; A47C 21/00; A47C 21/006; A61H 1/00; A61H 1/005; A61H 23/00; A61H 23/006; A61H 2201/0142; A61H 2201/0146; A61H 2205/081

USPC ..... 5/600, 658, 915, 933; 601/49, 56, 57, 601/86, 90, 98

See application file for complete search history.

(56) References Cited

U.S. PATENT DOCUMENTS

| | | | | | |
|---|---|---|---|---|---|
| 3,457,911 | A * | 7/1969 | Carpenter | A61H 23/0263 | 5/421 |
| 4,326,506 | A * | 4/1982 | Kawabata | A61H 1/00 | 5/694 |
| 4,989,584 | A * | 2/1991 | Simon | A61H 1/00 | 5/648 |
| 5,007,410 | A * | 4/1991 | DeLaney | A47C 21/006 | 5/694 |
| 5,022,384 | A * | 6/1991 | Freels | A61H 23/0263 | 318/129 |
| 5,584,797 | A * | 12/1996 | Yoo | A61H 23/0263 | 601/46 |
| 7,297,126 | B2 * | 11/2007 | Kries | | 5/915 |
| 2006/0211960 | A1 * | 9/2006 | Kries | | 601/57 |

(Continued)

*Primary Examiner* — Robert G Santos

(74) *Attorney, Agent, or Firm* — Felix L. Fischer

(57) ABSTRACT

A massage motor support incorporates a frame having an upper frame element and a lower frame element. A support membrane having a central aperture in a web with a securing plate and massage motor engaged through the central aperture is supported in the frame with the web engaged between clamping surfaces on the upper and lower frame elements.

6 Claims, 6 Drawing Sheets

(56) References Cited

U.S. PATENT DOCUMENTS

| | | | | |
|---|---|---|---|---|
| 2015/0313369 | A1* | 11/2015 | Tarplee | A61H 23/0254<br>601/57 |
| 2016/0113410 | A1* | 4/2016 | Ermalovich | A47C 21/006<br>248/205.1 |
| 2017/0065092 | A1* | 3/2017 | Fissette | A61H 23/02 |

* cited by examiner

MASSAGE MOTOR SUPPORT APPARATUS FOR AN ADJUSTABLE BED

REFERENCE TO RELATED APPLICATIONS

This application claims priority of U.S. provisional application Ser. No. 62/068,149 filed on Oct. 24, 2014 entitled MASSAGE MOTOR SUPPORT APPARATUS FOR AN ADJUSTABLE BED, the disclosure of which is incorporated herein by reference.

BACKGROUND

Field

This invention relates generally to the field of adjustable beds and more particularly to a structure for supporting a massage motor for attachment to mattress supporting planes in the bed for improved energy direction.

Description of the Related Art

Articulating beds have long been used in hospital and healthcare facilities to allow positioning of a patient in a reclining position, sitting position, elevated leg position or combinations of these positions. General usage of articulating beds has been rapidly expanding due to the comfort and convenience available from adjusting the bed to desired positions for reading, general relaxation or sleeping.

Development of the articulating or adjustable beds for personal or home use has been further enhanced with the introduction of massage units to provide restful massage for the upper or lower back, thighs or lower legs. Transmission of the vibratory energy to the mattress may be significantly damped by the material of the mattress and is also impacted by the supporting structure for the massage motor. Prior art beds typically employ a box structure or covered shell for mounting of the motor to the mattress support element.

It is therefore desirable to provide a support structure for massage motors allowing greatest efficiency in directing energy of the motor into useful massage action.

SUMMARY

The embodiments disclosed herein overcome the shortcomings of the prior art by providing a massage motor support having a frame having an upper frame element and a lower frame element. A support membrane having a central aperture in a web, with a securing plate and massage motor engaged through the central aperture, is supported in the frame with the web engaged between clamping surfaces on the upper and lower frame elements.

BRIEF DESCRIPTION OF THE DRAWINGS

These and other features and advantages of the present invention will be better understood by reference to the following detailed description of exemplary embodiments when considered in connection with the accompanying drawings wherein.

DETAILED DESCRIPTION

Figure 1A:
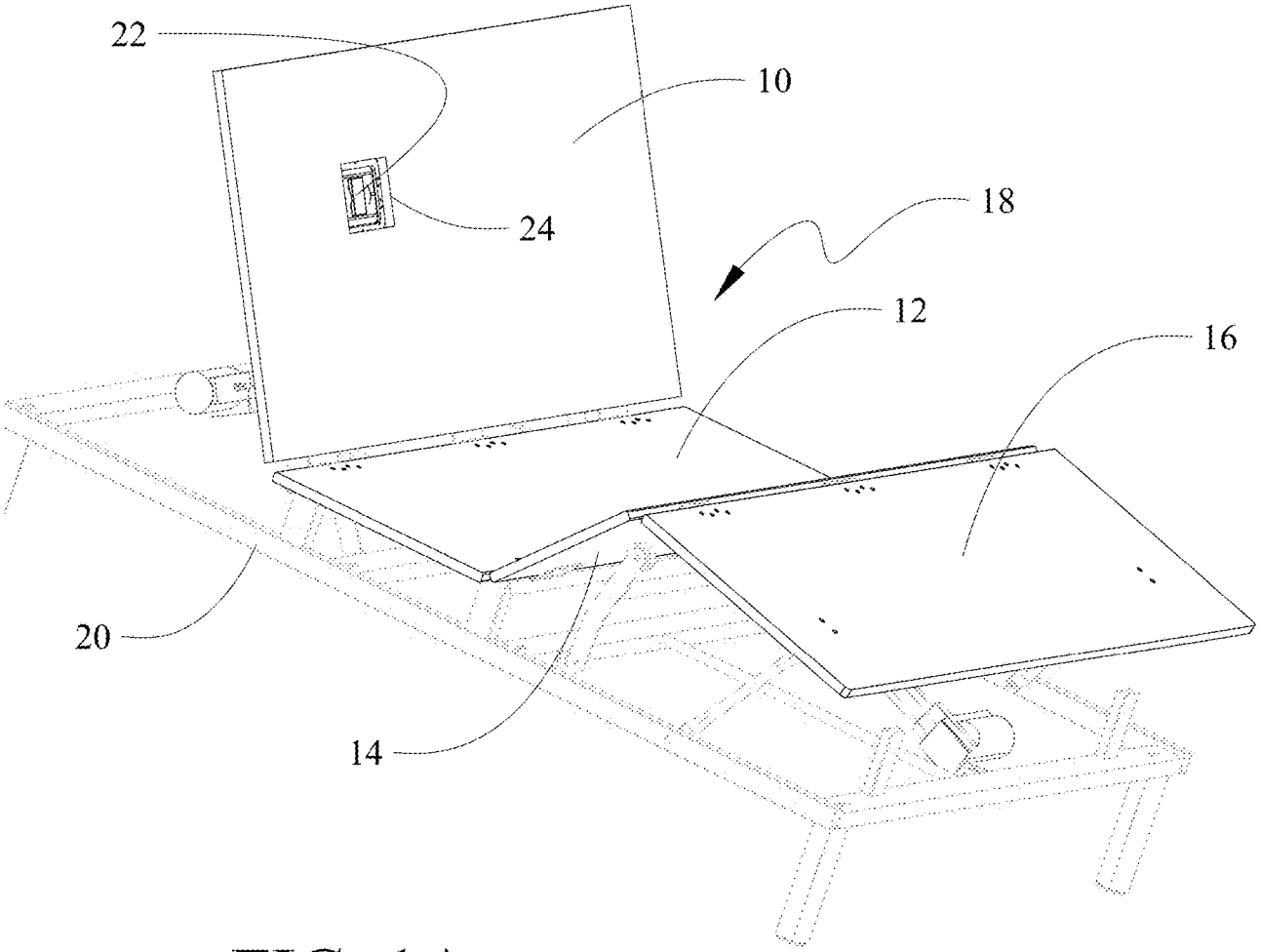
FIG. 1A is an front isometric view of an articulating bed usable with the present embodiment in an articulated position.

Embodiments shown in the drawings and described herein provide a bed frame for an articulating bed that is an attractive piece of furniture while providing safety benefits for preventing injuries due to collision, pinching and overbalancing. As shown in FIG. 1, the elements of the articulating structure for the bed, shown in an upwardly articulated position for all moving elements, include a head portion 10, a seat portion 12, a thigh portion 14 and a foot portion 16. Each of the articulating elements is formed with a rigid planar support. The combined articulating structure for supporting a mattress is generally designated 18 for reference. The articulating structure is supported on a bed frame 20. Motion of the articulating elements may be achieved as disclosed in U.S. patent application Ser. No. 14/161,957 filed on Jan. 23, 2014 entitled ARTICULATING BED WITH SIMPLIFIED ACTUATION having a common assignee with the present application, which is referenced as though fully set forth herein, or similar structure.

Figure 1B:
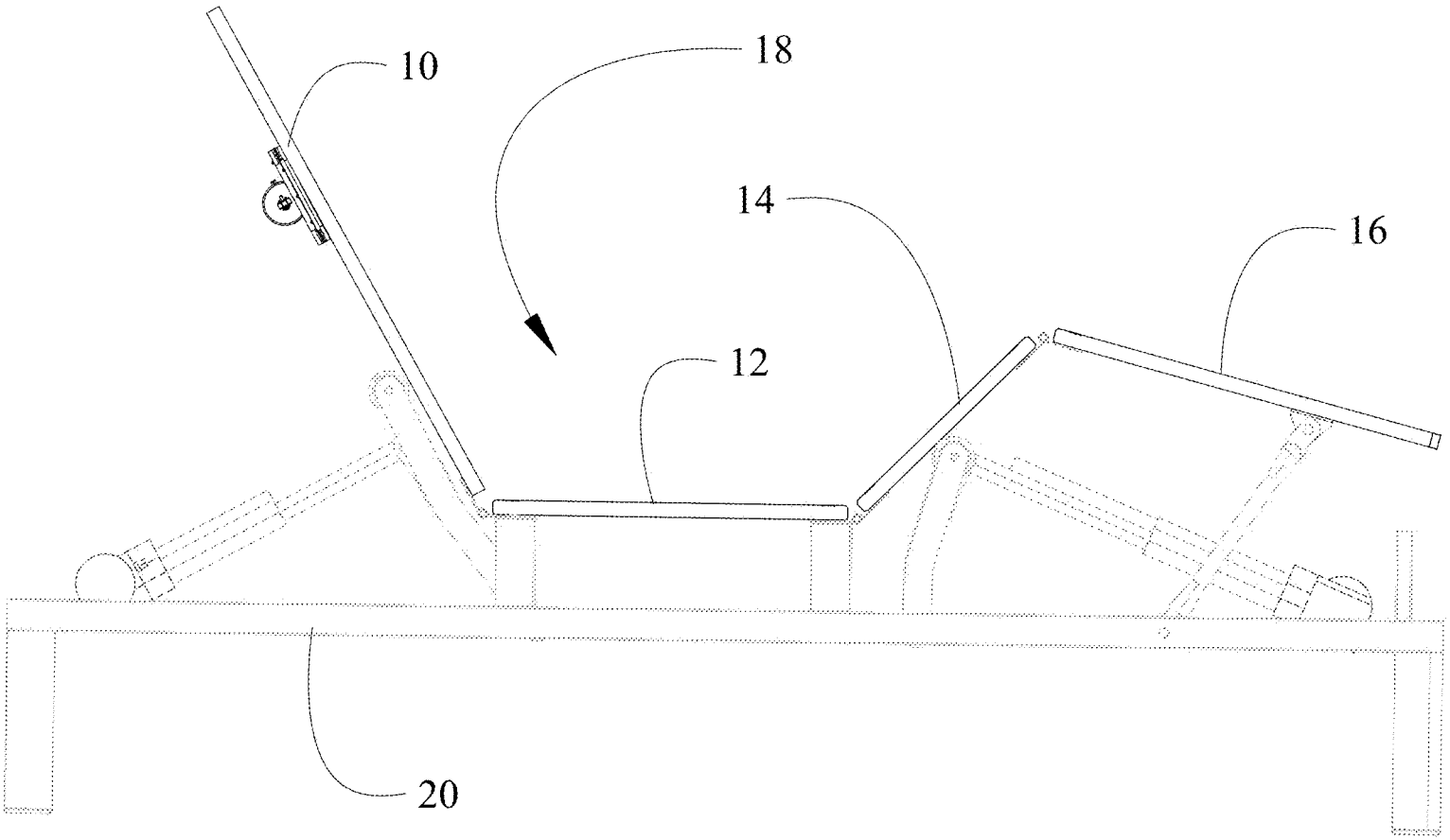
FIG. 1B is a side view of the articulating bed of FIG. 1.

As seen in FIGS. 1A and 1B, a massage motor assembly 22 is provided for upper back massage (only one position of an exemplary massage motor is shown and those skilled in the art will recognize that multiple locations for massage motors to provide upper back, lower back, or leg massage for an occupant or both occupants of a double, queen or king bed may be present). An aperture 24 in the head portion 10 of the mattress support allows transmission of the energy from the massage motor into the mattress (not shown).

Figure 2:
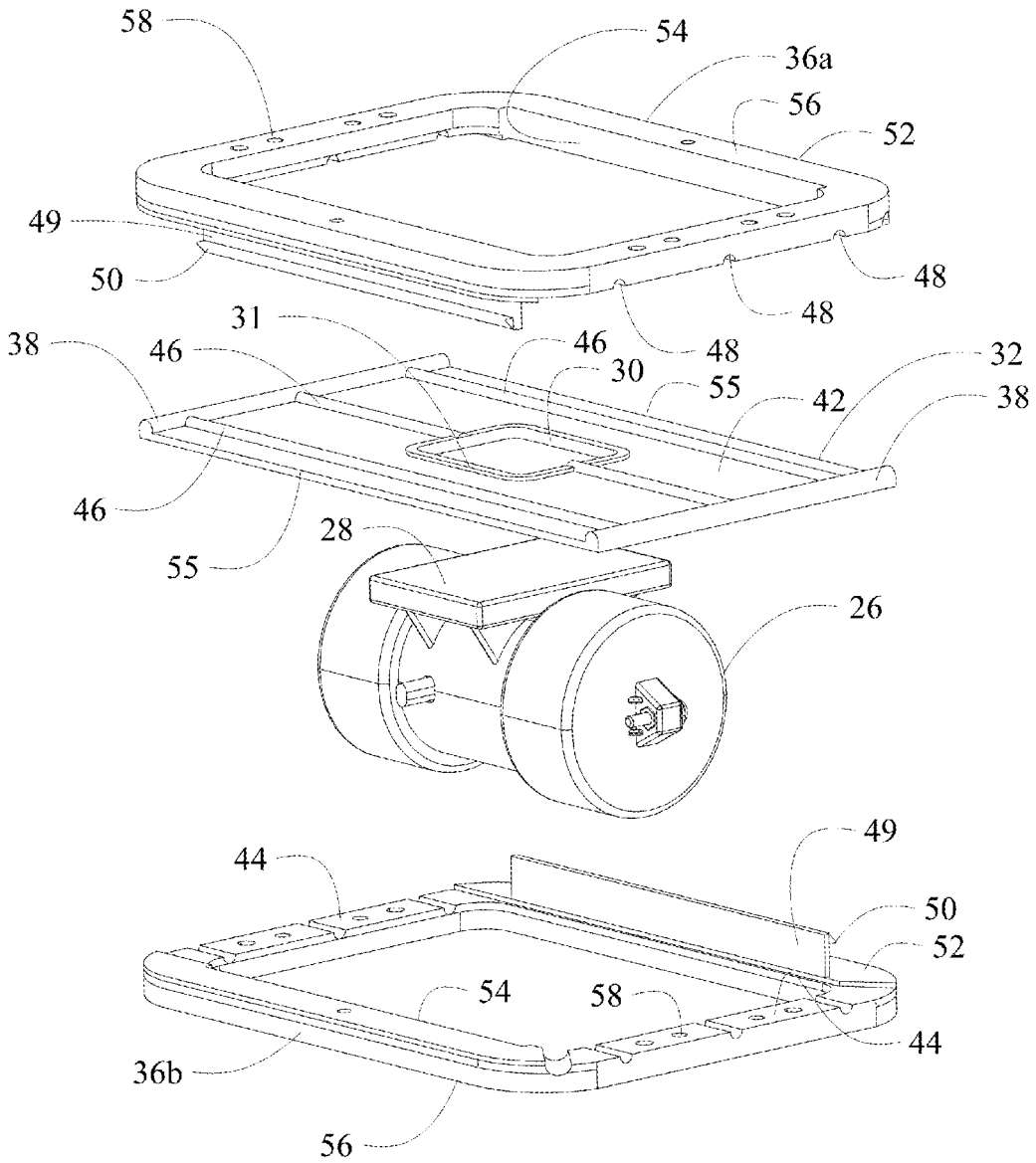
FIG. 2 is an isometric exploded view of an exemplary embodiment of the massage motor support structure demonstrating the elements of the structure.
Figure 3A:
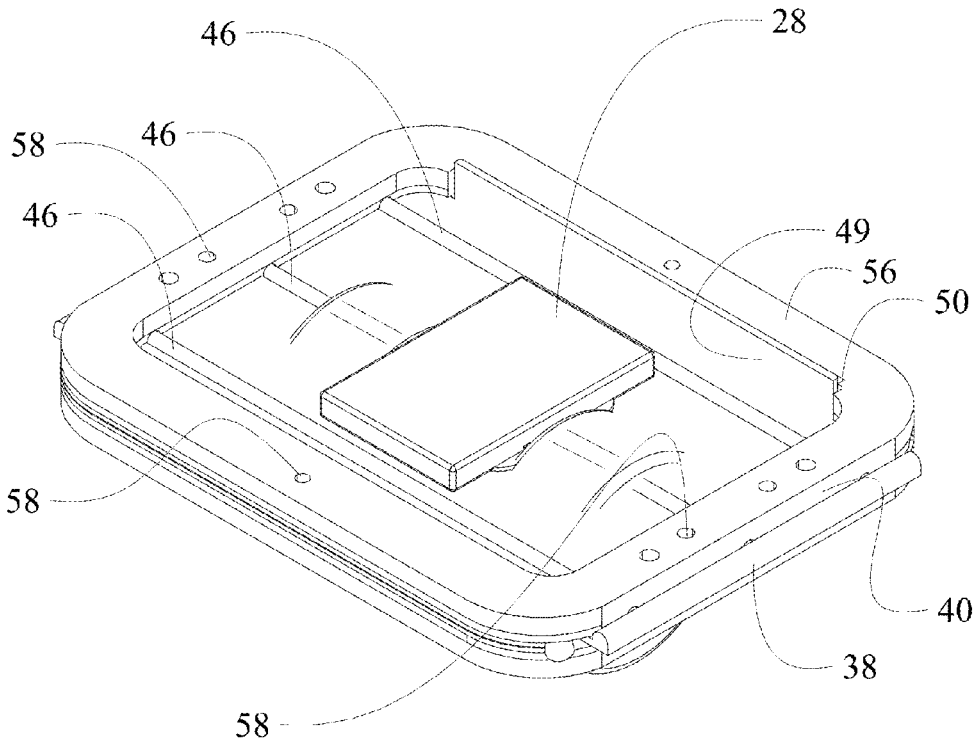
FIG. 3A is an upper pictorial view of the exemplary embodiment in the assembled condition.
Figure 3B:
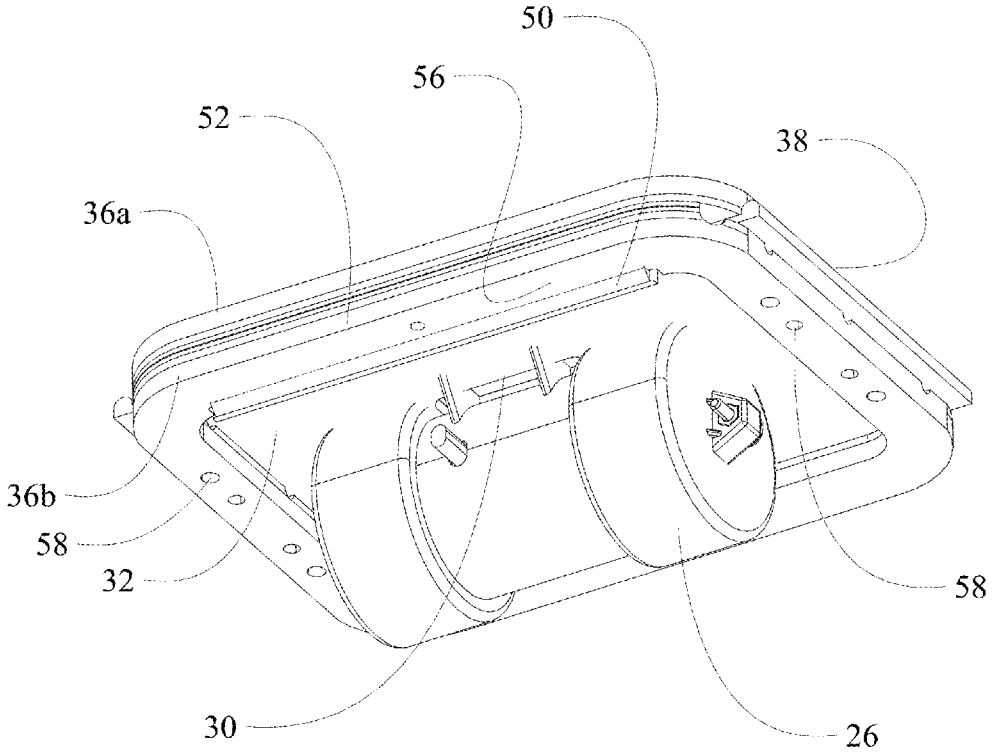
FIG. 3B is a lower pictorial view of the exemplary embodiment in the assembled condition; and, FIG. 3C is a side section view of the assembled embodiment.

To enhance the efficiency in assembly of the massage motor into the articulating elements of the bed and to provide greater energy focus and improved massage characteristics, the present embodiment of the massage motor assembly 22 shown in FIGS. 2, 3A and 3B includes a massage motor 26 which is attached with a securing plate 28 through an aperture 30 in a support membrane 32. The aperture 30 is located substantially in the geometric center of the support membrane 32. While shown in the drawings as rectangular, the aperture 30 may be circular or employ an alternative geometric form to accommodate the engagement between the massage motor and securing plate. The support membrane 32 may be fabricated from rubber, silicone or other appropriate resilient material. For the embodiments shown, the support membrane 32 is sufficiently flexible to allow stretching of the aperture 30 for insertion of the securing plate and resilient retraction of the aperture trapping the motor 26 on one side of the membrane and the securing plate 28 on the opposite side of the membrane thereby suspending the motor within the support membrane. In alternative embodiments, the securing plate may be removable and attached by bolts or similar fasteners to the motor to trap the membrane surrounding the aperture between the motor and securing plate. As shown in FIG. 2, a ridge 31 surrounds aperture 30 to enhance the resilient engagement of the massage motor 26 and securing plate 28 with the support membrane.

The support membrane 32 is secured within a frame 34 having an upper frame element 36*a* and a lower frame element 36*b*. Lips 38 on the support membrane 32 are engaged by external longitudinal surfaces 40 on the upper frame element 36*a* while web 42 of the support membrane 32 is engaged between clamping surfaces 44 on the upper and lower frame elements 36*a*, 36*b* to engage the support member in the frame. To further secure the support membrane in the frame, longitudinally extending ribs 46 embossed or otherwise formed on the web 42 are received in cutouts 48 in the clamping surfaces 44. The lips 38 and ribs 46 as constrained by the frame 34 maintain the web 42 in a substantially planar orientation parallel to the frame. Reaction of the support membrane 32 to vibratory motion of the massage motor 26 as constrained by the frame 34 focuses energy of the vibration perpendicular to the frame 34 and through the aperture 24 in the head portion 10 of the mattress support of the articulating structure 18.

Figure 3C:
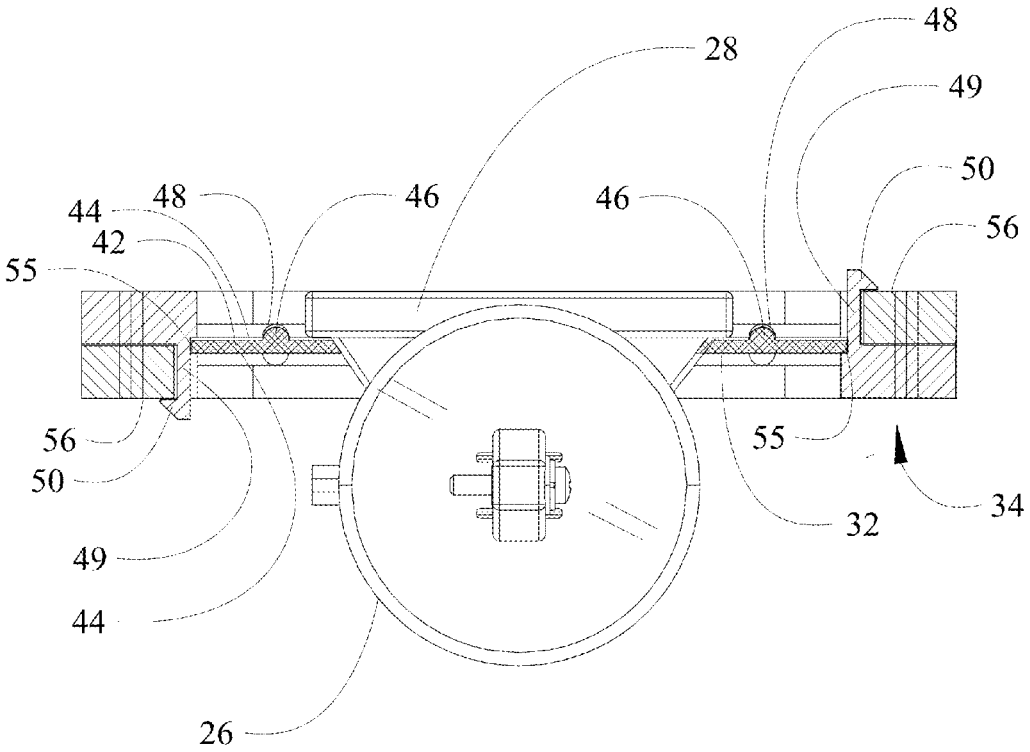

As best seen in FIG. 2, for the present embodiment, the upper and lower support frame elements 36*a* and 36*b* are identical in structure and arranged symmetrically allowing a single part configuration to be used for both elements. A resilient securing flange 49 having a protruding lip 50 extends from a side 52 of the frame element 36*a*, 36*b*. The frame elements 36*a* and 36*b* are assembled trapping the support membrane 32 by engaging the support membrane with one frame element, the ribs 46 received within cutouts 48 and lips 38 constrained by the external longitudinal surface 40, and interlacing the securing flanges 49 with the opposing inner lateral surfaces 54 of frame sides 52, the flanges extending between the inner lateral surfaces of the frame sides and lateral edges 55 of the support membrane 32 as best seen in FIG. 3C. The securing flanges 49 have sufficient depth to allow lips 50 to be received over the face 56 adjacent the frame side 52 with the web of the support membrane slightly compressed. Resilience of the securing flanges 49 allows sufficient lateral displacement of the flanges for the lips 50 to pass over the inner lateral surface 54 and then spring into a securing position over the face 56 with the flange substantially abutting the frame side as shown in FIG. 3C.

Apertures 58 through the sides of the frame 34 allow bolts or other fasteners to be employed to secure the frame to the rigid planar support of the head portion 10 (or other element of the articulating structure as previously described.

Having now described various embodiments of the invention in detail as required by the patent statutes, those skilled in the art will recognize modifications and substitutions to the specific embodiments disclosed herein. Such modifications are within the scope and intent of the present invention as defined in the following claims.

What is claimed is:

1. A massage motor support comprising:

a frame having an upper frame element and a lower frame element;

a support membrane having a central aperture in a web, a securing plate and massage motor (26) engaged through said central aperture, said web engaged between clamping surfaces on the upper and lower frame elements, wherein the support membrane further incorporates longitudinal ribs extending from said web to be received in cutouts in the clamping surface of at least one of said upper and lower frame elements.

2. A massage motor support comprising:

a frame having an upper frame element and a lower frame element;

a support membrane having a central aperture in a web, a securing plate and massage motor engaged through said central aperture, said web engaged between clamping surfaces on the upper and lower frame elements, wherein the support membrane incorporates lips on longitudinal edges thereof which engage an external longitudinal surface on at least one of said upper and lower frame elements constraining said support membrane in the frame.

3. A massage motor support comprising:

a frame having an upper frame element and a lower frame element wherein the upper frame element is engaged to the lower frame element with resilient securing flanges received against lateral inner walls of the frame elements, said securing flanges having lips received over faces of the frame elements;

a support membrane having a central aperture in a web, a securing plate and massage engaged through said central aperture, said web engaged between clamping surfaces on the upper and lower frame elements.

4. The massage motor support as defined in claim 3 wherein the upper and lower frame elements are identical and arranged symmetrically to engage the support membrane and each frame element has one securing flange received against a lateral inner surface of the other frame element.

5. The massage motor support as defined in claim 3 wherein the frame has apertures to receive fasteners securing the frame to a rigid support for a mattress on an articulating support structure.

6. The massage motor support as defined in claim 3 wherein the securing flanges extend between lateral inner surfaces of the frame and lateral edges of the support membrane.

* * * * *